US007208930B1

(12) United States Patent
Tran et al.

(10) Patent No.: US 7,208,930 B1
(45) Date of Patent: Apr. 24, 2007

(54) BANDGAP VOLTAGE REGULATOR

(75) Inventors: Chau C. Tran, Malden, MA (US); A. Paul Brokaw, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 307 days.

(21) Appl. No.: 11/033,058

(22) Filed: Jan. 10, 2005

(51) Int. Cl.
*G05F 3/16* (2006.01)

(52) U.S. Cl. ..... 323/314; 323/907

(58) Field of Classification Search ..... 323/313, 323/314, 907
See application file for complete search history.

(56) References Cited

U.S. PATENT DOCUMENTS 5,394,078 A * 2/1995 Brokaw ..... 323/313
5,563,504 A * 10/1996 Gilbert et al. ..... 323/316
5,933,045 A * 8/1999 Audy et al. ..... 327/513
5,982,201 A * 11/1999 Brokaw et al. ..... 327/53
6,958,643 B2 * 10/2005 Rosenthal ..... 327/540
7,012,416 B2 * 3/2006 Marinca ..... 323/316
7,053,694 B2 * 5/2006 Ozawa ..... 327/539
7,088,085 B2 * 8/2006 Marinca ..... 323/314
7,113,025 B2 * 9/2006 Washburn ..... 327/539
7,122,997 B1 * 10/2006 Werking ..... 323/313
7,129,774 B1 * 10/2006 Bosnyak ..... 327/539

OTHER PUBLICATIONS

*Band-Gap-Referenced Biasing Circuits, Analysis and Design of Analog Integrated Circuits, Third Edition*, pp. 338-346; Published 1942, Copyright 1993, Paul R. Gray/Robert G. Meyer.

* cited by examiner

*Primary Examiner*—Jeffrey Sterrett
(74) *Attorney, Agent, or Firm*—Koppel, Patrick, Heybl & Dawson

(57) ABSTRACT

A bandgap voltage regulator is arranged such that, when a desired output voltage is present between its output and common terminals, current densities in a pair of bipolar transistors having unequal emitter areas are maintained in a fixed ratio. The difference in the transistors' base-emitter voltages is across a resistor, which thus conducts a PTAT current. The regulator also generates a CTAT current, and both the PTAT and CTAT currents are made to flow in another resistor, with the resulting voltages added by superposition. The regulator's resistors are sized such that $V_{out}$ is an integral or fractional multiple of $V_{bg}$, where $V_{bg}$ is the bandgap voltage for the fabrication process used to make the regulator's transistors, such that $V_{out}$ is temperature invariant, to a first order. The resistors are preferably realized using unit resistors having a predetermined resistance, or series and/or parallel combinations of unit resistors.

23 Claims, 5 Drawing Sheets

BANDGAP VOLTAGE REGULATOR

BACKGROUND OF THE INVENTION

1. Field of the Invention

This invention relates to the field of bandgap voltage references, and particularly to bandgap voltage regulators capable of providing an output voltage which is a multiple of the bandgap voltage.

2. Description of the Related Art

Voltage references based on the bandgap voltage of silicon and having low temperature coefficients are well-known. The Widlar bandgap voltage reference shown in FIG. 1*a* is one such circuit. When arranged as shown, the reference produces an output $V_{ref}$ given by:

$$V_{ref}=V_{be(Qc)}+(R_b/R_c)\Delta V_{be},$$

where $\Delta V_{be}$ is given by:

$$\Delta V_{be}=(kT/q)ln(J_a/J_b),$$

where $J_a$ and $J_b$ are the current densities at the emitters of transistors $Q_a$ and $Q_b$, respectively. When the circuit is arranged such that $V_{be(Qc)}+(R_b/R_c)\Delta V_{be}=V_{bg}$, where $V_{bg}$ is the bandgap voltage for the fabrication process used to make the reference's bipolar transistors, the reference will be temperature compensated. The $V_{be}$ portion of $V_{ref}$ is referred to as the "CTAT" component, since $V_{be}$ is complementary-to-absolute-temperature (CTAT), and the $\Delta V_{be}$ portion of $V_{ref}$ is referred to as the "PTAT" component (proportional-to-absolute-temperature).

This design has several shortcomings, however. For example, the reference's operating current (I) is derived from the supply voltage (V+), and therefore varies with power supply variances. $V_{be(Qc)}$ must vary to tolerate the changing current, resulting in inaccuracies in $V_{ref}$. In addition, if a reference voltage greater than the bandgap voltage is needed, an amplifier must be employed to multiply the bandgap voltage to the desired value.

One bandgap voltage regulator capable of producing a temperature compensated output voltage greater than $V_{bg}$ is shown in FIG. 1*b*. P-n junctions are stacked as necessary to obtain a desired integral multiple of the bandgap voltage; here, transistors $Q_d$, $Q_e$, $Q_f$, and $Q_g$ are stacked to provide the CTAT component of the output voltage. However, using this approach, a large multiple requires a large number of transistors, and only integral multiples of the bandgap voltage can be produced.

SUMMARY OF THE INVENTION

A bandgap voltage regulator is presented which overcomes the problems noted above, providing a temperature compensated output voltage which may be an integral or fractional multiple of the bandgap voltage.

The present regulator is arranged such that, when a desired output voltage is present between the regulator's output and common terminals, current densities in a pair of bipolar transistors (Q1 and Q2) having unequal emitter areas are maintained in a fixed ratio. These transistors and a resistor are connected such that the difference in the base-emitter voltages of Q1 and Q2 is across the resistor, such that the voltage across and the current in the resistor are proportional-to-absolute-temperature (PTAT). The regulator is further arranged to generate a current which is complementary-to-absolute-temperature (CTAT). The PTAT and CTAT currents are both made to flow in another resistor, with the resulting voltages added by superposition. The regulator's resistors are sized such that $V_{out}$ is a multiple of $V_{bg}$, where $V_{bg}$ is the bandgap voltage for the fabrication process used to make the regulator's bipolar transistors, such that $V_{out}$ is temperature invariant, to a first order.

Several alternate embodiments are described, each of which produces a temperature compensated output voltage which can be an integral or fractional multiple of the bandgap voltage. Each may be realized using unit resistors having a predetermined resistance, or series and/or parallel combinations of such unit resistors—which reduces or eliminates the need for resistor trimming.

Further features and advantages of the invention will be apparent to those skilled in the art from the following detailed description, taken together with the accompanying drawings.

DETAILED DESCRIPTION OF THE INVENTION

The present invention is a bandgap voltage regulator capable of producing a temperature compensated output voltage which is an integral or fractional multiple of the bandgap voltage. The output voltage is set by properly selecting the values of several resistances, which may be realized using unit resistors having a predetermined resistance, or series and/or parallel combinations of such unit resistors.

Figure 1A:
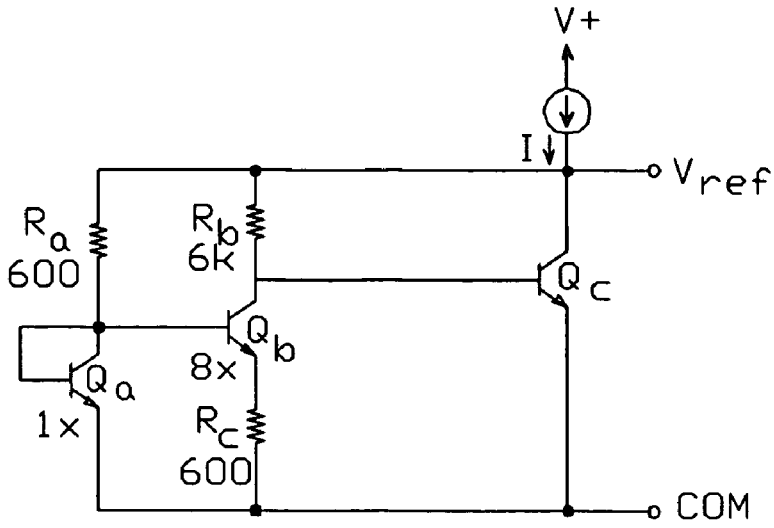
FIG. 1a (Prior Art)
FIG. 1*a* is a schematic diagram of a known bandgap voltage reference.
Figure 1B:
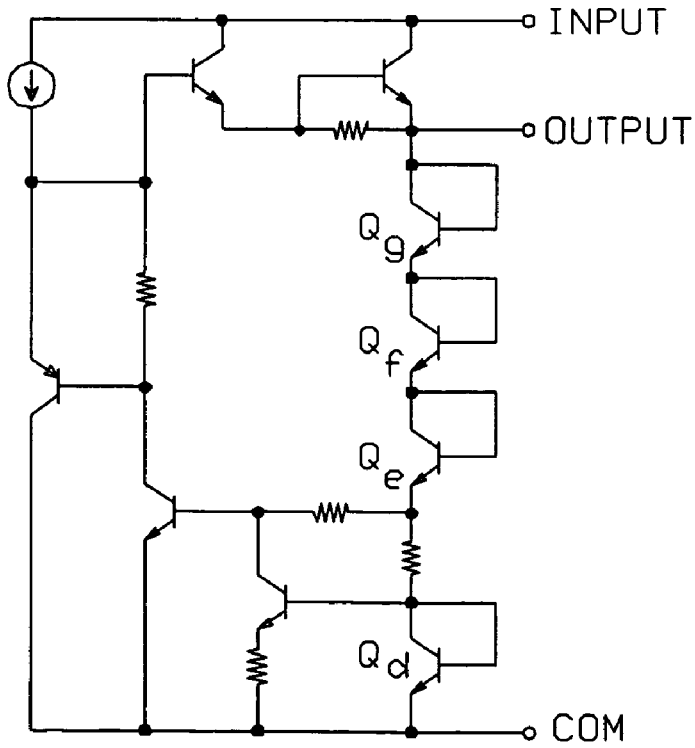
FIG. 1b (Prior Art)
FIG. 1*b* is a schematic diagram of known bandgap voltage regulator.
Figure 2:
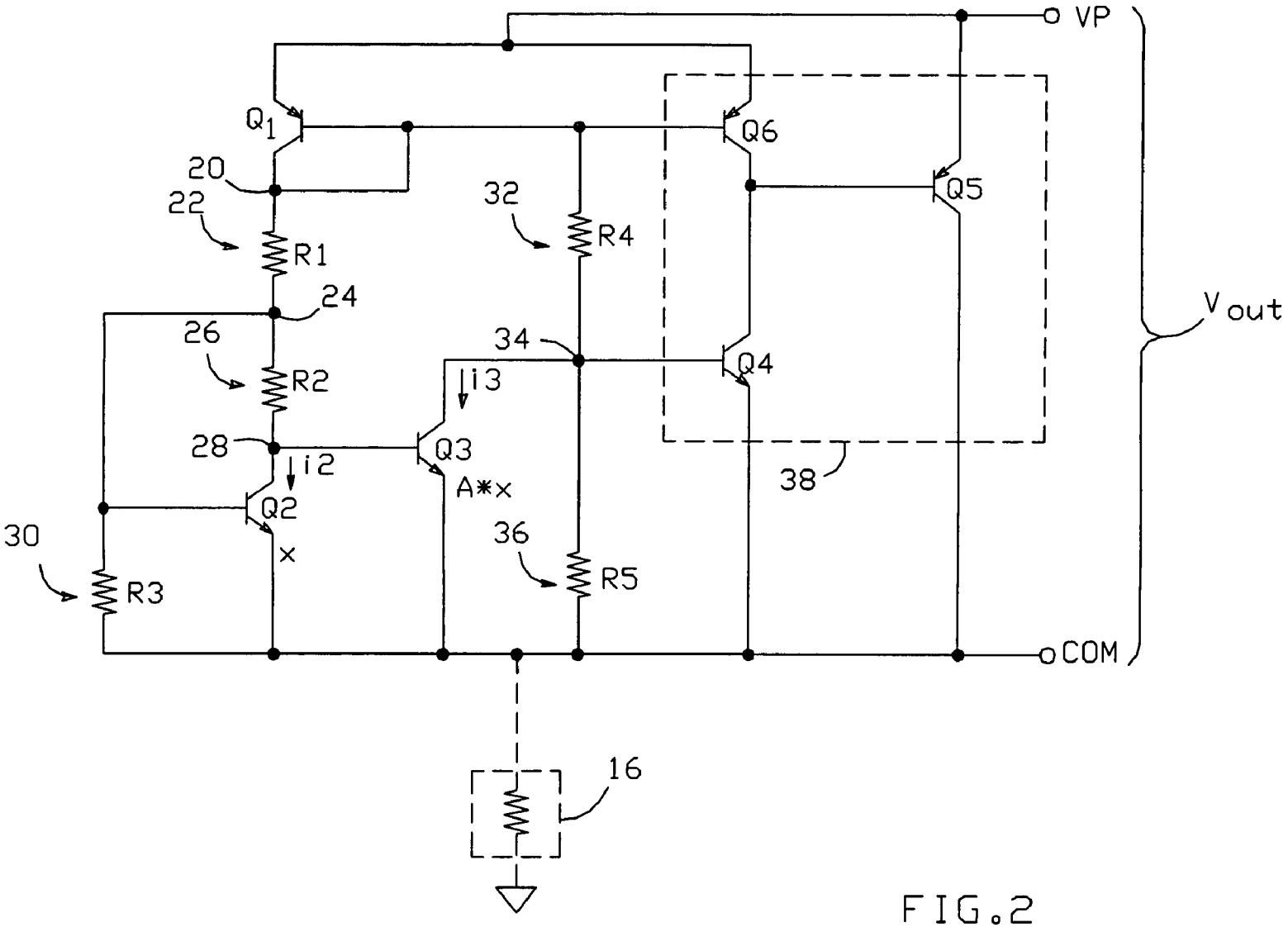
FIG. 2 is a schematic diagram of one embodiment of a bandgap voltage regulator per the present invention.

One possible embodiment of the present regulator is shown in FIG. 2. The regulator includes an output terminal VP and a common terminal COM, with the regulated output voltage $V_{out}$ appearing between VP and COM; a current or high impedance source circuit 16 provides a return path for the output current. Output voltage $V_{out}$ will include a PTAT component and a CTAT component, which are summed to produce a $V_{out}$ which is temperature invariant, to a first order.

A diode-connected bipolar transistor Q1 is connected between VP and a node 20 such that it supplies a current to the node. A resistor 22 having a resistance R1 is connected between node 20 and a second node 24. A resistor 26 having a resistance R2 is connected between node 24 and a node 28.

The regulator also includes a bipolar transistor Q2 having its collector-emitter circuit connected between node 28 and COM; Q2 has an emitter area equal to 'x'. A third resistor 30 having a resistance R3 is connected at one terminal to the emitter of Q2 and COM, and at its other terminal to the base of Q2 and to node 24, such that Q2's base-emitter voltage ($V_{be(Q2)}$) is across R3.

A resistor 32 having a resistance R4 is connected between node 20 and a node 34, and a resistor 36 having a resistance R5 is connected between node 34 and COM. A bipolar transistor Q3 having an emitter area equal to A*x has its base connected to node 28, its emitter connected to COM, and its collector connected to node 34.

The exemplary regulator embodiment shown in FIG. 2 also includes an amplifier 38, which is arranged to control the voltage $V_{out}$ between VP and COM so as to stabilize the collector voltage of Q3 and make the voltages at the base of Q2 and the collector of Q3 approximately equal. This causes the current $i_2$ in Q2 and the current $i_3$ in Q3 to be in a fixed ratio. The areas of Q2 and Q3 are also in a fixed ratio (A:1), and thus the current densities in Q2 and Q3 (J2 and J3, respectively) are in a fixed ratio. Therefore, the voltage ($V_{R2}$) across resistor 26, which is equal to the difference between the base-emitter voltages of Q2 and Q3 ($V_{R2}=\Delta V_{BE}=V_{be(Q2)}-V_{be(Q3)}=(kT/q)\ln(J2/J3)$), will be PTAT. This makes the current in resistor 26, as well as a component of the current in resistor 22, PTAT. Since currents $i_2$ and $i_3$ are ratio matched, a component of the current in resistor 32 will also be PTAT. These PTAT currents produce a PTAT voltage component V(PTAT) in $V_{out}$. Resistances R1 and R4 can be made as large or small as desired, with respect to R2, to scale the PTAT voltage component.

Q2's base-emitter voltage creates a CTAT current in R3, and thus a component of CTAT current in R1. This current, along with the base-emitter voltage of Q1, provide a CTAT voltage component V(CTAT) in $V_{out}$. Resistors R1–R5 are sized such that $V_{out}$ (=V(PTAT)+V(CTAT)) is a multiple of $V_{bg}$, where $V_{bg}$ is the bandgap voltage for the fabrication process used to make the regulator's bipolar transistors, such that $V_{out}$ is temperature invariant, to a first order.

Amplifier 38 preferably comprises a transistor Q4 having its collector-emitter circuit coupled between VP and COM and its base connected to node 34, and a transistor Q5 having its collector-emitter circuit connected between VP and COM and its base connected to the collector of Q4. A transistor Q6 is preferably connected between VP and Q4 as shown, to mirror the current in Q1 to Q4.

Since amplifier 38 works to stabilize the base-emitter voltage of Q4, and thus the collector voltage of Q3, it has to pull up on VP by enough to force the $V_{be}$-proportional currents required by R3 and R5 to flow in R1 and R4, which adds a CTAT component of voltage to the PTAT voltage component resulting from the current required to maintain the PTAT voltage across R2. By causing the current in R1 and R4 to flow in diode-connected Q1, a well-defined current is mirrored by Q6 to Q4, thereby controlling Q4's base-emitter voltage and the voltage at node 34.

The operation of amplifier 38 is now explained in more detail. The present regulator functions as a shunt regulator. VP is pulled up to forward bias Q1 and pull up on R1, which in turn pulls up the base of Q2. At the same time, R4 pulls up the base of Q4, limited by R5. When Q4's base is sufficiently forward biased, it turns on and pulls down on the base of output transistor Q5; Q5 absorbs the driving current, limiting the increase in voltage at VP. Neglecting the effect of Q3, this occurs when R5 has a base-emitter voltage (of Q4) across it, so there will be additional base-emitter voltages across R4.

The ratio of R1 to R3 is preferably made equal to the ratio of R4 to R5. When so arranged, the voltage at the base of Q2 should be sufficient to turn it on. As Q2 comes on, it draws some current from R1 via R2. Transistor Q3 draws a similar current from R4, which pulls down the base of Q4 and allows the base of Q5—and voltage VP—to rise. VP rises to a desired selected multiple of $V_{be}$, plus an amount proportional to currents $i_2$ and $i_3$, which are in a fixed ratio. Since Q3 is larger than Q2, it has a lower base voltage than Q2, and this $\Delta V_{BE}$ sets the voltage across R2. Q4 drives Q5 to maintain $i_2$ and $i_3$ nearly equal; if they are not, the base of Q4 is driven up or down so as to restore their balance. The actual value of the PTAT voltage component in $V_{out}$ which maintains the balance can be adjusted with the ratio of R2 to R1. The ratio of R1 to R3 can be selected to set the total output voltage, with the nominal value of R2 adjusted to set the necessary level of PTAT current.

The CTAT component of the output voltage will be two base-emitter voltages (Q1 and Q2), plus a possibly fractional number of base-emitter voltages implied by the ratio of R1 to R3. This does not constrain the values of R1 and R4, so that their ratios to R2 can be selected to provide as much PTAT voltage as may be required to augment the CTAT voltage and bring VP up to the required bandgap multiple.

As noted above, $V_{out}$=V(PTAT)+V(CTAT). When arranged as shown in FIG. 2, V(PTAT) is given by:

$$V(PTAT)=[((kT/q)(\ln((A*i_2)/i_3)))/R2]*R1,$$

and V(CTAT) is given by:

$$V(CTAT)=V_{be(Q2)}(1+(R1/R3))+V_{be(Q1)},$$

where kT/q is the thermal voltage, and $V_{be(Q2)}$ and $V_{be(Q1)}$ are the base-emitter voltages of Q2 and Q1, respectively.

The resistors used in the present regulator are preferably "unit" resistors—i.e., resistors which are identically made and thus match one another—or series and/or parallel combinations of unit resistors. Using such resistors to provide matching ratios results in a ratio which is very robust in manufacture. If the desired ratios are integral, the ratios can be easily set. For example, if $V_{be}$ is to be multiplied by 3, R1 needs to be twice R3, and R4 twice R5. This could be accomplished by, for example, using one unit resistor for R3 and one for R5, with R1 and R4 each made from two unit resistors.

However, the ratio of R2 to R1 also needs to be controlled, preferably (for the sake of simplicity) by fixing R1 and adjusting R2. This may be difficult, as the ratio of R2 to R1 needs to be large because the actual $\Delta V_{BE}$ across R2 will be much smaller than the PTAT voltage component across R1 needs to be. This may be addressed by trying to use parallel unit resistors to make small values. However, there is not necessarily any reasonably sized unit of resistance which will satisfy the R2:R1 ratio.

Figure 3:
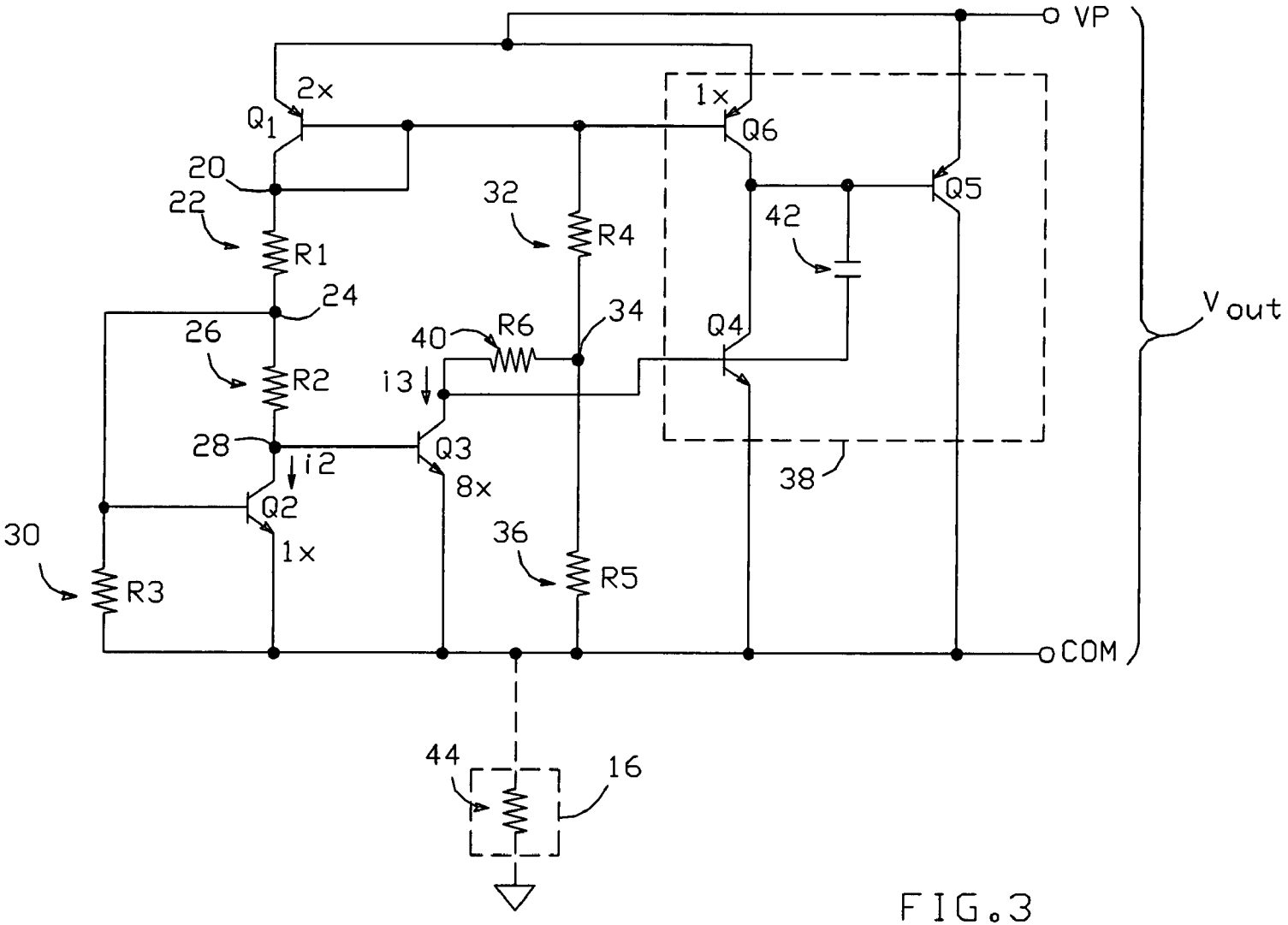
FIG. 3 is a schematic diagram of a preferred embodiment of the bandgap voltage regulator of FIG. 2.

One approach which enables the use of desired ratio to be obtained using a reasonably sized unit resistor is shown in FIG. 3, which depicts a preferred implementation of this embodiment of the present regulator. A resistor 40 having a resistance R6 is interposed between node 34 and the collector of Q3, with the base of Q4 connected to the Q3 collector side of R6. When the circuit is in equilibrium, VP is at a particular desired voltage, which in turn requires the base of Q4 to be at a particular voltage. If R6 is made non-zero, the current in Q3 has to become smaller to maintain the same VP and $V_{be(Q4)}$ voltages. That is, the collector voltage of Q3 must remain the same while the load resistance goes up. This will slightly change the ratio of $i_3$ to $i_2$, and the resulting $\Delta V_{BE}$ across R2. Thus, the value of R2 can be set to be a convenient submultiple of R1, and then R6 can be adjusted to change $\Delta V_{BE}$ to the value necessary to achieve the desired temperature compensated output voltage. In most cases, the value of R6 will be small and overall VP errors due to its failure to ideally match the rest of the resistors are smaller still.

The preferred implementation shown in FIG. 3 also includes a capacitor 42 which provides frequency compensation. The ratio between the emitter sizes of transistors Q1 and Q6 is preferably 2:1, so that the current in the Q6/Q4 branch is approximately equal to that in R1 or R4. The ratio between the emitter sizes of transistor Q3 and Q2 is preferably at least 8:1. FIG. 3 also illustrates one possible implementation for current or high impedance source circuit 16: a single resistor 44.

Figure 4:
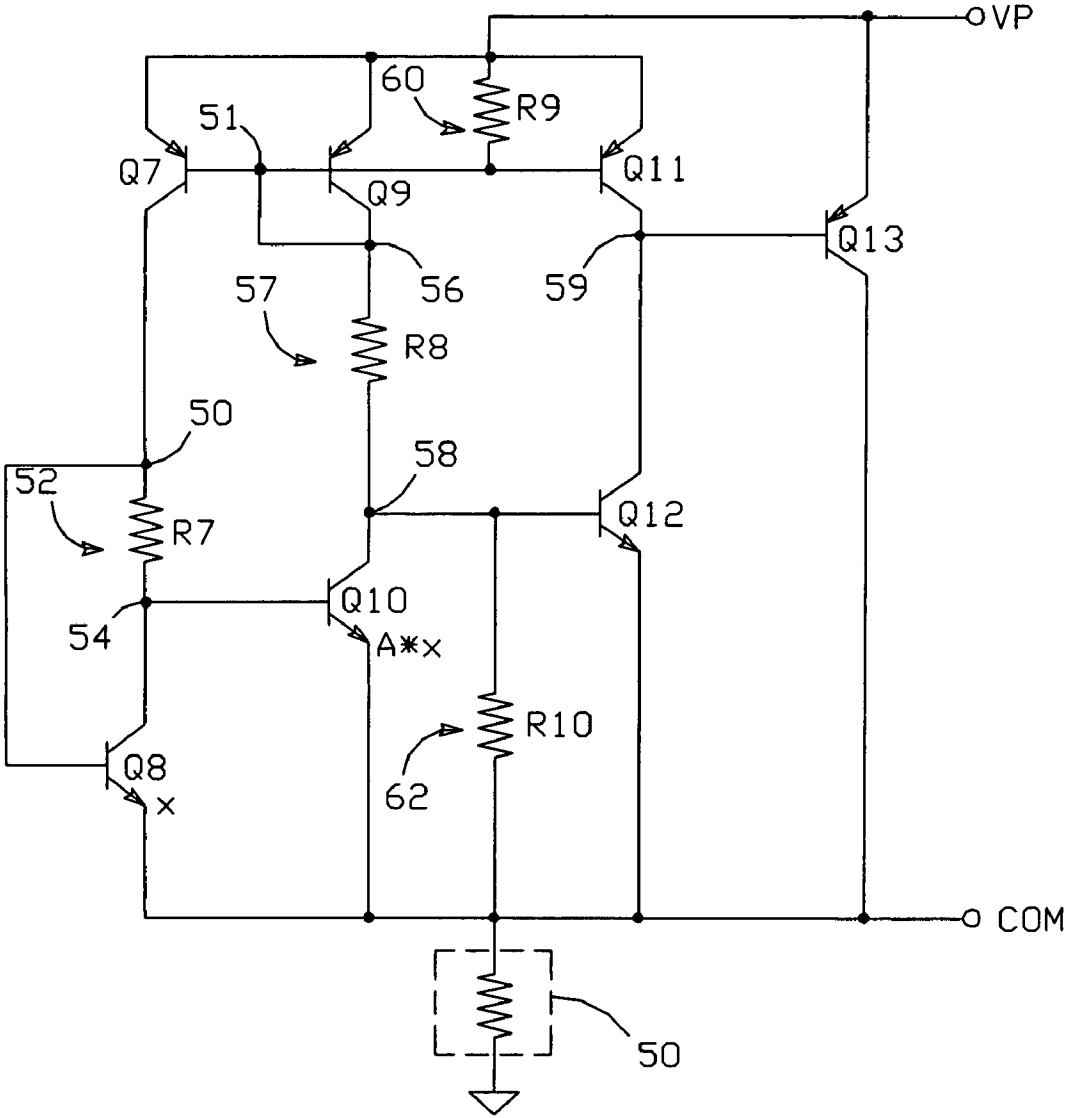
FIG. 4 is a schematic diagram of another embodiment of a bandgap voltage regulator per the present invention.

Another possible embodiment of the present regulator is shown in FIG. 4, which enables a user to obtain a temperature compensated output voltage that is an integral or fractional multiple of the bandgap voltage, simply by properly selecting several resistor values. As before, the regulator includes an output terminal VP and a common terminal COM, with the regulated output voltage $V_{out}$ appearing between VP and COM. A current or high impedance source circuit 50 provides a return path for the output current, and $V_{out}$ includes PTAT and CTAT components which add to produce a $V_{out}$ which is temperature invariant, to a first order.

In the exemplary implementation shown in FIG. 4, the collector-emitter circuit of a transistor Q7 is connected between VP and a node 50, and its base is connected to a node 51. A resistor 52 having a resistance R7 is connected between node 50 and a node 54. A transistor Q8 having an emitter size 'x' has its collector-emitter circuit connected between node 54 and COM and its base connected to node 50. A diode-connected transistor Q9 is connected between VP and a node 56, with its base/collector connected to node 51, and a resistor 57 having a resistance R8 is connected between node 56 and a node 58. A transistor Q10 having an emitter size 'A*x' has its collector-emitter circuit connected between node 58 and COM and its base connected to node 54.

A transistor Q11 has its collector-emitter circuit connected between VP and a node 59, with its base connected to node 51, and a transistor Q12 is connected between node 59 and COM, with its base connected to node 58. An output transistor Q13 has its collector-emitter circuit connected between VP and COM, with its base connected to node 59. A resistor 60 having a resistance R9 is connected between VP and node 51, and a resistor 62 having a resistance R10 is connected between node 58 and COM.

In operation, the regulator of FIG. 4 maintains a voltage $V_{out}$ between VP and COM such that the collector currents of Q8 and Q10 are approximately equal, thereby maintaining the current densities in Q8 and Q10 in a fixed ratio such that the difference voltage $\Delta V_{BE}=V_{be(Q8)}-V_{be(Q10)}$ across R7, the current in R7, and a component of the current in R8 are PTAT. The base-emitter voltages of Q11 and Q12 create a current having a CTAT component in R8, such that R8 carries both CTAT and PTAT components. The regulator's resistors are sized to make $V_{out}$ a desired multiple of $V_{bg}$, where $V_{bg}$ is the bandgap voltage for the fabrication process used to make the regulator's bipolar transistors, such that $V_{out}$ is temperature invariant, to a first order.

The operation of the regulator in FIG. 4 is now explained in more detail. As VP increases with respect to COM, both Q11 and Q12 are turned on, drawing a current which flows from VP to COM which tends to resist further increases in VP. This current flows when R9 and R10 each have a base-emitter voltage across them.

As Q11 turns on, so will Q7. Q7's current pulls up the base of Q10 by way of R7, and the resulting Q10 current pulls down the base of Q12, preventing it from limiting the rise of VP. Q12 should let VP rise until it reaches a selected multiple of base-emitter voltages set by the ratio of R8 to R9, plus the voltage added to R8 by the Q10 current. Above that, Q12 should come on and pull down the base of Q13, causing it to draw current and limit the rise of VP.

Any current from R8 in excess of that which is needed to bias R9 to a base-emitter voltage must flow in the collector of Q9. Q9 is the input of a current mirror to Q7 and Q11. The current in R8 in excess of the R10 current—i.e., the collector current of Q10—is mirrored to the collectors of Q7 and Q11. Q11's collector current is mirrored back to Q8, R7, and the base of Q10. Thus, Q8 and Q10 run at equal collector currents, and since Q10 is larger, $\Delta V_{BE}=V_{be(Q8)}-V_{be(Q10)}$ must appear across R7. The magnitude of the current circulating in this loop is given by $\Delta V_{BE}$/R7, which is necessarily a PTAT current that can be sized to add just enough PTAT voltage to the voltage drop across R8 to compensate the total number of base-emitter voltages, plus the $V_{be}$ multiple across R8. If VP exceeds this voltage, the base of Q12 is pulled up, causing it to drive Q13 so as to sink more current.

When so arranged, output voltage $V_{out}$ is given by:

$$V_{out}=V(PTAT)+V(CTAT), \text{ with } V(PTAT) \text{ given by:}$$

$$V(PTAT)=(R8/R7)*(kT/q)(\ln Ai_8/i_{10})$$

and V(CTAT) given by:

$$V(CTAT)=V_{be(Q11)}*(1+(R8/R9))+V_{be(Q12)},$$

where $i_8$ and $i_{10}$ are the currents in Q8 and Q10, respectively, and $V_{be(Q11)}$ and $V_{be(Q12)}$ are the base-emitter voltages of Q11 and Q12, respectively.

As an example, a $V_{out}$ of approximately 4.85 volts is realized when R8=200 kΩ, R9 and R10=100 kΩ, R7=5850Ω, and A=8 (assuming kT/q≈26 mv and $V_{be(Q11)}=V_{be(Q12)}$=0.75 v).

As with the embodiment shown in FIG. 2, the ratio of resistors connected across a base-emitter voltage (here, R9 and R10) to a series resistor (R8) is set to add a freely chosen CTAT multiple to two $V_{be}$'s, and a PTAT current is created in the series resistor to compensate the CTAT component and thereby provide a temperature stable regulator circuit.

Also as in FIG. 2, the resistors used in the present regulator are preferably made from unit resistors, or series and/or parallel combinations of unit resistors.

Figure 5:
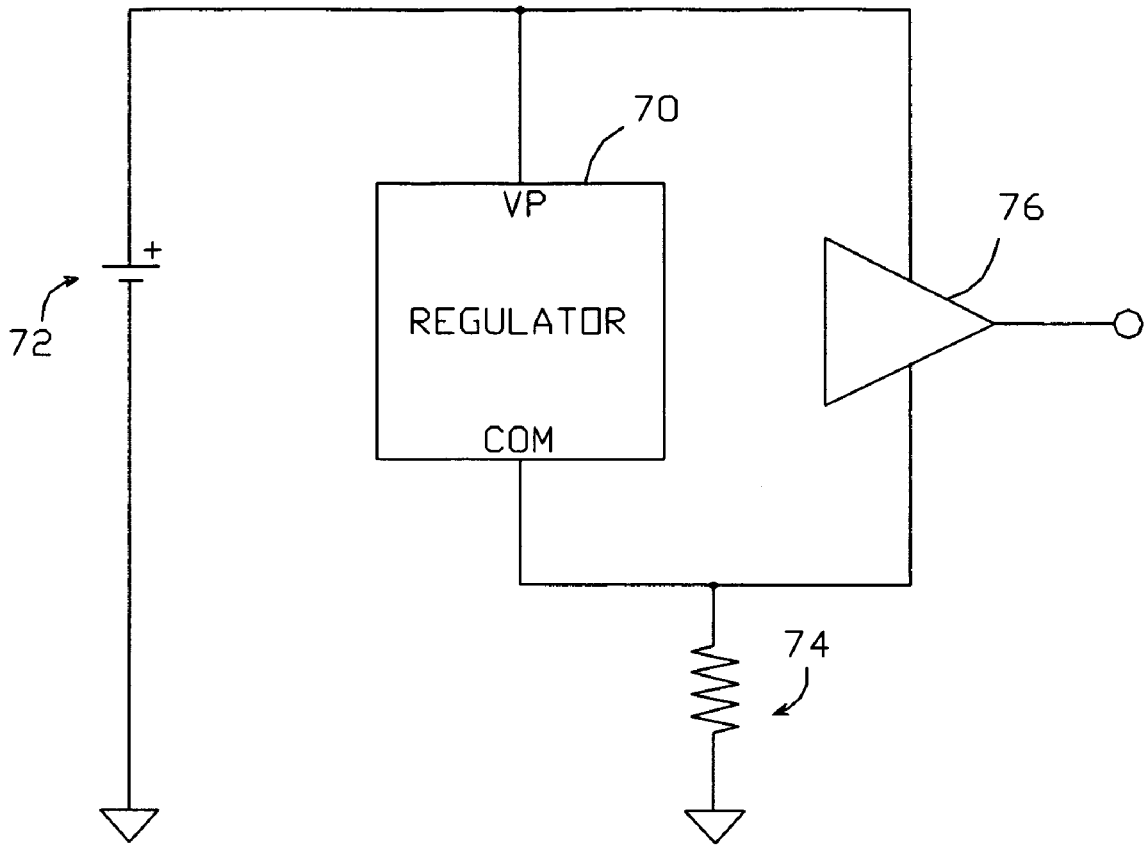
FIG. 5 is a block/schematic diagram of an application which includes a bandgap voltage regulator per the present invention.

The present regulator is suitably employed in high voltage applications, as shown in FIG. 5. A regulator 70 in accordance with the present invention has its VP terminal connected to a supply voltage 72, and its COM terminal connected to ground via a current or high impedance source circuit such as a simple resistor 74 (as shown). A device to be powered, such as an operational amplifier 76, is then connected between VP and COM, and regulator 70 provides a regulated output voltage across the amplifier. In this way, the device to be powered is not exposed to what might be a very high supply voltage.

A particular application of the present invention as a voltage limiter which protects a powered device such as an op amp from a high supply voltage can be found in co-pending U.S. application Ser. No. 10/762,647.

While particular embodiments of the invention have been shown and described, numerous variations and alternate embodiments will occur to those skilled in the art. Accordingly, it is intended that the invention be limited only in terms of the appended claims.

We claim:

1. A bandgap voltage regulator, comprising:

an output terminal (VP);

a common terminal (COM);

a first diode-connected bipolar transistor (Q1) connected between said output terminal and a first node such that it supplies a current to said first node;

a first resistor (R1) connected between said first node and a second node;

a second resistor (R2) connected between said second node and a third node;

a second bipolar transistor (Q2) having an emitter area x, said second bipolar transistor's collector-emitter circuit connected between said third node and said common terminal and its base terminal connected to said second node;

a third resistor (R3) connected between the base and emitter of said second bipolar transistor, such that said second bipolar transistor's base-emitter voltage is across said third resistor;

a fourth resistor (R4) connected between said first node and a fourth node;

a fifth resistor (R5) connected between said fourth node and said common terminal;

a third bipolar transistor (Q3) having an emitter area A*x, where A>0, said third bipolar transistor's base connected to said third node, its emitter connected to said common terminal, and its collector connected to said fourth node; and an amplifier arranged to maintain a voltage $V_{out}$ between said output terminal and said common terminal such that the voltages at the base of said second bipolar transistor and the collector of said third bipolar transistor are approximately equal, thereby maintaining the current densities in said second and third bipolar transistors in a fixed ratio such that the difference voltage $\Delta V_{BE}=V_{be(Q2)}-V_{be(Q3)}$ across said second resistor, the current in said second resistor, and a component of the currents in said first and fourth resistors are proportional-to-absolute-temperature (PTAT), said second bipolar transistor's base-emitter voltage creating a complementary-to-absolute-temperature (CTAT) current in said third resistor and a component of CTAT current in said first resistor, said resistors sized such that $V_{out}$ is a multiple of $V_{bg}$, where $V_{bg}$ is the bandgap voltage for the fabrication process used to make the regulator's bipolar transistors, such that $V_{out}$ is temperature invariant, to a first order.

2. The regulator of claim 1, wherein the ratio of the resistances of said first resistor to said third resistor is approximately equal to the ratio of the resistances of said fourth resistor to said fifth resistor.

3. The regulator of claim 2, wherein the resistances of said first resistor and said fourth resistor are approximately equal and the resistances of said third resistor and said fifth resistor are approximately equal.

4. The regulator of claim 1, wherein said amplifier comprises:

a fourth bipolar transistor (Q4) having its collector-emitter circuit connected between said output terminal and said common terminal and its base coupled to the collector of said third bipolar transistor; and a fifth bipolar transistor (Q5) having its collector-emitter circuit connected between said output terminal and said common terminal and its base connected to the collector of said fourth bipolar transistor.

5. The regulator of claim 4, wherein said amplifier further comprises a sixth bipolar transistor (Q6) having its collector-emitter circuit connected between said output terminal and the collector-emitter circuit of said fourth bipolar transistor such that said sixth bipolar transistor supplies current to said fourth bipolar transistor.

6. The regulator of claim 1, wherein said regulator is arranged such that $V_{out}$=V(PTAT)+V(CTAT), where:

$$V(PTAT)=[((kT/q)(\ln Ai_2/i_3))/R2]*R1, \text{ and}$$

$$V(CTAT)=V_{be(Q2)}(1+(R1/R3))+V_{be(Q1)},$$

where kT/q is the thermal voltage, $i_2$ and $i_3$ are the currents in said second and third bipolar transistors, respectively, $V_{be(Q2)}$ and $V_{be(Q1)}$ are the base-emitter voltages of said second and first bipolar transistors, respectively, and R1, R2 and R3 are the resistances of said first, second and third resistors, respectively.

7. The regulator of claim 1, wherein the resistance of each of said resistors is made from a unit resistor having a predetermined resistance, or a series and/or parallel combination of said unit resistors.

8. The regulator of claim 1, further comprising a resistor (R6) interposed between the collector of said third bipolar transistor and said fourth node, wherein the resistance of each of said resistors is made from a unit resistor having a predetermined resistance, or a series and/or parallel combination of said unit resistors.

9. The regulator of claim 1, further comprising a current or high impedance source circuit connected between said common terminal and a circuit ground point.

10. The regulator of claim 9, wherein said current or high impedance source circuit is a resistor.

11. The regulator of claim 1, said regulator arranged such that $V_{out}$ is a fractional multiple of $V_{bg}$.

12. A bandgap voltage regulator, comprising:

an output terminal (VP);

a common terminal (COM);

a first diode-connected PNP bipolar transistor (Q1) connected between said output terminal and a first node such that it supplies a current to said first node;

a first resistor (R1) connected between said first node and a second node;

a second resistor (R2) connected between said second node and a third node;

a first NPN bipolar transistor (Q2) having an emitter area x, said first NPN bipolar transistor's collector-emitter circuit connected between said third node and said common terminal and its base terminal connected to said second node;

a third resistor (R3) connected between the base and emitter of said first NPN bipolar transistor, such that said first NPN bipolar transistor's base-emitter voltage is across said third resistor;

a fourth resistor (R4) connected between said first node and a fourth node;

a fifth resistor (R5) connected between said fourth node and said common terminal, said resistors arranged such that the ratio of the resistances of said first resistor to said third resistor is approximately equal to the ratio of the resistances of said fourth resistor to said fifth resistor;

a second NPN bipolar transistor (Q3) having an emitter area A*x, where A>0, said second NPN bipolar transistor's base connected to said third node, its emitter connected to said common terminal, and its collector connected to said fourth node; and an amplifier arranged to maintain a voltage $V_{out}$ between said output and common terminals such that the voltages at the base of said first NPN bipolar transistor and the collector of said second NPN bipolar transistor are approximately equal, thereby maintaining the current densities in said first and second NPN bipolar transistors in a fixed ratio such that the difference voltage $\Delta V_{BE}=V_{be(Q2)}-V_{be(Q3)}$ across said second resistor, the current in said second resistor, and a component of the currents in said first and fourth resistors are proportional-to-absolute-temperature (PTAT), said amplifier comprising:

a third NPN bipolar transistor (Q4) having its collector-emitter circuit connected between said output and common terminals and its base coupled to the collector of said second NPN bipolar transistor, and a second PNP bipolar transistor (Q5) having its collector-emitter circuit connected between said output and common terminals and its base connected to the collector of said third NPN bipolar transistor;

said first NPN bipolar transistor's base-emitter voltage creating a complementary-to-absolute-temperature (CTAT) current in said third resistor and a component of CTAT current in said first resistor, said resistors sized such that $V_{out}$ is a multiple of $V_{bg}$, where $V_{bg}$ is the bandgap voltage for the fabrication process used to make the regulator's bipolar transistors, such that $V_{out}$ is temperature invariant, to a first order.

13. The regulator of claim 12, wherein the resistances of said first and fourth resistors are approximately equal and the resistances of said third and fifth resistors are approximately equal.

14. The regulator of claim 12, wherein said amplifier further comprises a third PNP bipolar transistor (Q6) having its collector-emitter circuit connected between said output terminal and the collector-emitter circuit of said third NPN bipolar transistor such that said third PNP bipolar transistor supplies current to said third NPN bipolar transistor.

15. The regulator of claim 12, wherein said regulator is arranged such that $V_{out}$=V(PTAT)+V(CTAT), where:

$$V(PTAT)=[((kT/q)(\ln Ai_2/i_3))/R2]*R1, \text{ and}$$

$$V(CTAT)=V_{be(Q2)}(1+(R1/R3))+V_{be(Q1)},$$

where kT/q is the thermal voltage, $i_2$ and $i_3$ are the currents in said first and second NPN bipolar transistors, respectively, $V_{be(Q2)}$ and $V_{be(Q1)}$ are the base-emitter voltages of said first NPN bipolar transistor and said first diode-connected PNP transistor, respectively, and R1, R2 and R3 are the resistances of resistors said first, second and third resistors, respectively.

16. A bandgap voltage regulator, comprising:

an output terminal (VP);

a common terminal (COM);

a first bipolar transistor (Q7) connected between said output terminal and a first node such that it supplies a current to said first node;

a first resistor (R7) connected between said first node and a second node;

a second bipolar transistor (Q8) having an emitter area x, its collector-emitter circuit connected between said second node and said common terminal and its base connected to said first node;

a third diode-connected bipolar transistor (Q9) connected between said output terminal and a third node such that it supplies a current to said third node;

a second resistor (R8) connected between said third node and a fourth node;

a fourth bipolar transistor (Q10) having an emitter area A*x, where A>0, said fourth bipolar transistor's base connected to said second node, its emitter connected to said common terminal, and its collector connected to said fourth node;

a fifth bipolar transistor (Q11) having its collector-emitter circuit connected between said output terminal and a fifth node and its base connected to said third node;

a third resistor (R9) connected between said output terminal and said third node such that said fifth bipolar transistor's base-emitter voltage is across said third resistor;

a sixth bipolar transistor (Q12) having its collector-emitter circuit connected between said fifth node and said common terminal and its base connected to said fourth node;

a fourth resistor (R10) connected between said common terminal and said fourth node such that said sixth bipolar transistor's base-emitter voltage is across said fourth resistor; and a seventh bipolar transistor (Q13) having its collector-emitter circuit connected between said output and common terminals;

said regulator arranged to maintain a voltage $V_{out}$ between said output and common terminals such that the collector currents of said second and fourth bipolar transistors are approximately equal, thereby maintaining the current densities in said second and fourth bipolar transistors in a fixed ratio such that the difference voltage $\Delta V_{BE}=V_{be(Q8)}-V_{be(Q10)}$ across said first resistor, the current in said first resistor, and a component of the current in said second resistor are proportional-to-absolute-temperature (PTAT);

the base-emitter voltages of said fifth and sixth bipolar transistors creating currents having a complementary-to-absolute-temperature (CTAT) component in said second resistor, said resistors sized such that $V_{out}$ is a desired multiple of $V_{bg}$, where $V_{bg}$ is the bandgap voltage for the fabrication process used to make the regulator's bipolar transistors, such that $V_{out}$ is temperature invariant, to a first order.

17. The regulator of claim 16, wherein the resistances of said third and fourth resistors are approximately equal and the resistance of said second resistor is approximately equal to twice the resistance of said third resistor.

18. The regulator of claim 16, wherein said regulator is arranged such that $V_{out}$=V(PTAT)+V(CTAT), where:

$$V(PTAT)=(kT/q)(\ln Ai_8/i_{10})*(R8/R7), \text{ and}$$

$$V(CTAT)=V_{be(Q11)}(1+(R8/R9))+V_{be(Q12)},$$

where kT/q is the thermal voltage, $i_8$ and $i_{10}$ are the currents in said second and fourth bipolar transistors, respectively, $V_{be(Q11)}$and $V_{be(Q12)}$are the base-emitter voltages of said fifth and sixth bipolar transistors, respectively, and R7, R8 and R9 are the resistances of said first, second and third resistors, respectively.

19. The regulator of claim 16, wherein the resistance of each of said resistors is made from a unit resistor having a predetermined resistance, or a series and/or parallel combination of said unit resistors.

20. The regulator of claim 16, further comprising a current or high impedance source circuit connected between said common terminal and a circuit ground point.

21. The regulator of claim 20, wherein said current or high impedance source circuit is a resistor.

22. The regulator of claim 16, said regulator arranged such that $V_{out}$ is a fractional multiple of $V_{bg}$.

23. The regulator of claim 16, wherein said first, third and fifth bipolar transistors are PNP transistors and said second, fourth and sixth transistors are NPN transistors.

* * * * *